US005265485A

United States Patent [19]

Sakamoto et al.

[11] Patent Number: 5,265,485

[45] Date of Patent: Nov. 30, 1993

[54] STARTING MOTOR WITH AN INTERMEDIATE GEAR

[75] Inventors: Toshio Sakamoto, Aioi; Shuzou Isozumi, Himeji, both of Japan

[73] Assignee: Mitsubishi Denki Kabushiki Kaisha, Tokyo, Japan

[21] Appl. No.: 968,518

[22] Filed: Oct. 29, 1992

[30] Foreign Application Priority Data

Nov. 12, 1991 [JP] Japan ..... 3-101382[U]

[51] Int. Cl.[5] ..... F02N 15/06

[52] U.S. Cl. ..... 74/7 E; 74/7 A; 290/38 C

[58] Field of Search ..... 74/6, 7 R, 7 A, 7 E; 290/38 R, 38 C, 48; 403/364, 475

[56] References Cited

U.S. PATENT DOCUMENTS

| | | | |
|---|---|---|---|
| 4,525,632 | 6/1985 | Tanaka | 74/7 A X |
| 4,974,463 | 12/1990 | Luiki | 74/7 A |
| 5,110,093 | 5/1992 | Tanaka | 74/7 A X |
| 5,165,293 | 11/1992 | Kittaka et al. | 74/7 E X |

*Primary Examiner*—Allan D. Herrmann
*Assistant Examiner*—David W. Laub
*Attorney, Agent, or Firm*—Sughrue, Mion, Zinn, Macpeak and Seas

[57] ABSTRACT

A starting motor with an intermediate gear wherein rotation of a rotating shaft of a DC motor is transmitted to a pinion in a one-way rotational direction by an over-running clutch, and an intermediate gear supported rotatably and forward-and-backward slidably by an intermediate shaft retained by insertion holes in a front end portion and a first back end portion of a front bracket and in mesh with the pinion, meshes with a ring-gear of an internal combustion engine by a forward movement thereof thereby starting the internal combustion engine, characterized by that; a polygonal hole is provided at a second back end portion of the front bracket communicating to the insertion hole in the first back end portion thereof; a spacer composed of a metallic material or a synthetic resin material, a section of which is a polygon, is inserted into the polygonal hole and fixed thereto blocking rotation thereof; a back end of the spacer is received by a front end of a yoke of the starting motor contacting the front end of the yoke with respect to the radial and axial directions thereof; a front end of the spacer connects to a back end of the intermediate shaft by a rotation-blocking means; and a buffer is interposed between the front end of the spacer and the back end of the intermediate shaft opposing thereto.

1 Claim, 3 Drawing Sheets

STARTING MOTOR WITH AN INTERMEDIATE GEAR

BACKGROUND OF THE INVENTION

1. Field of the Invention

This invention relates to a starting motor with an intermediate gear utilized in a vehicle, particularly to rotation-blocking fixation of an intermediate shaft thereof.

2. Discussion of Background

FIG. 4 is a longitudinal sectional diagram showing a conventional starting motor with an intermediate gear. A reference numeral 1 designates a DC motor, wherein a rotating shaft 3 is extended from an armature 2 and a field pole 6 is attached to a yoke 5 of a stator 4. A numeral 7 designates a front bracket connected to the yoke 5, which supports a front end of the rotating shaft 3 through a bearing 8.

A numeral 10 designates an overrunning clutch supported by the rotating shaft 3 slidably in the axial direction, composed as follows. A numeral 11 designates a clutch outer connected to an outer periphery of the rotating shaft 3 by a helical spline 9 thereby transmitting the rotation, and 12, a clutch inner to which a one-way rotation is transmitted through rollers 13 from the clutch outer 11, which is supported by the rotating shaft 3 through a sleeve bearing 19. A pinion 14 is integrally formed at a front end of the clutch inner 12. A numeral 15 designates a clutch cover fixed to the clutch outer 11 by calking through a holding plate 16, and 17, a stop ring attached to the clutch outer 11. An engaging groove 18 is formed between the stop ring 17 and a stepped portion of the clutch outer 11. A numeral 20 designates a stopper attached to the rotating shaft which restrains a forward movement position of the overrunning clutch 10.

A numeral 21 designates a shift lever, an intermediate fulcrum of which is supported by the front bracket 7 and a receiving body 24 that is received by a grommet 22 attached to the yoke 5 through a compression spring 23, and a forked lower end of which engages with the engaging groove 18 in the axial direction. An upper end of the shift lever 21 engages with a front end of a plunger of an electromagnetic switch (not shown) of the motor 1 in the axial direction and the shift lever 21 swivels around the fulcrum.

A numeral 25 designates an intermediate shaft paralleled with the rotating shaft 3 and supported by insertion holes **7*a* and 7*b* of the front bracket 7, and 26, a grommet (composed of a gummy material) inserted into a round hole 7*c* provided at a back end portion of the front bracket 7 communicating to the insertion hole 7*b* and engaged with a front end of the yoke 5, a front end of which engages with a back end of the intermediate shaft 25 and blocks rotation thereof. A numeral 27 designates an intermediate gear supported by the intermediate shaft 25 rotatably and slidably in the axial direction, through a sleeve bearing 28 fixed to an inner periphery thereof, which meshes with the pinion 14. A numeral 29 designates a ring-like co-rotating body fixed to an outer periphery of a clutch cover 15, a flange 29*a* of which engages with an engaging groove 27*a* provided at an outer periphery of a boss of the intermediate gear 27. In accordance with the forward and backward movement of the overrunning clutch 10, the intermediate gear 27 moves forwardly and backwardly by the ring-like co-rotating body 29. A numeral 30 designates a ring-gear provided at a flywheel of an internal combustion engine, which meshes with the intermediate gear 27** by the forward movement thereof, thereby starting to rotate the engine.

FIG. 5 is an exploded view showing the grommet 26 and the intermediate shaft 25. At a back end of the grommet 26, a rotation-blocking protrusion **26*b* is provided which contacts a stepped outer periphery of the yoke 5 thereby blocking the rotation thereof. At a front end of the grommet 26, a protrusion 26*a* is provided, which engages with an engaging groove 25*a* at a back end of the intermediate shaft 25**.

Next, explanation will be given to the operation. When current flows in an excitation coil of the electromagnetic switch, the plunger is drawn and swivels the shift lever 21 in the counterclockwise direction in FIG. 4. By this operation, the overrunning clutch 10 moves forwardly and is received by the stopper 20. By the forward movement of the overrunning clutch 10, the intermediate gear 27 moves forwardly by the ring-like co-rotational body 29 and meshes with the ring-gear 30. Next, fixed terminals of the electromagnetic switch (not shown) are closed, current flows in a circuit of the DC motor 1, the armature 2 starts rotating, the rotation of the rotating shaft 3 is transmitted to the intermediate gear 27 through the overrunning clutch 10 and the pinion 14 and the rotation is transmitted to the ring-gear 30, thereby starting up the internal combustion engine.

In the conventional starting motor with an intermediate gear, a co-rotation of the intermediate shaft 25 by the rotation of the intermediate gear 27 is blocked by the engagement with the grommet 26. However, the grommet 26 is composed of a gummy material, deformation thereof is caused, the rotation -blocking is performed insufficiently and, therefore, the durability thereof is poor. Furthermore, when the grommet 26 is made of a metallic material or a synthetic resin material, a portion of a level-difference may be caused at a portion receiving the thrust force, a play is formed in the intermediate shaft 25 and wear is generated at a thrust-receiving portion of the intermediate shaft.

SUMMARY OF THE INVENTION

It is an object of the present invention to solve the above problem and to provide a starting motor with an intermediate gear wherein an intermediate shaft is fixed to the front bracket without a play and the rotation-blocking is firmly performed.

According to an aspect of the present invention there is provided a starting motor with an intermediate gear wherein rotation of a rotating shaft of a DC motor is transmitted to a pinion in a one-way rotational direction by an overrunning clutch, and an intermediate gear supported rotatably and forward-and-backward slidably by an intermediate shaft retained by insertion holes in a front end portion and a first back end portion of a front bracket and in mesh with the pinion, meshes with a ring-gear of an internal combustion engine by a forward movement thereof thereby starting the internal combustion engine, characterized by that;

a polygonal hole is provided at a second back end portion of the front bracket communicating to the insertion hole in the first back end portion thereof;

a spacer composed of a metallic material or a synthetic resin material, a section of which is a polygon, is inserted into the polygonal hole and fixed thereto blocking rotation thereof;

a back end of the spacer is received by a front end of a yoke of the starting motor contacting the front end of the yoke with respect to the radial and axial directions thereof;

a front end of the spacer connects to a back end of the intermediate shaft by a rotation-blocking means; and a buffer is interposed between the front end of the spacer and the back end of the intermediate shaft opposing thereto.

The spacer having a large rigidity is inserted into the polygonal hole of the front bracket and contacts the front end of the yoke with the rotation-blocking and the front end thereof engages with the back end of the intermediate shaft with the rotation-blocking through which the rotation-blocking is performed with certainty. Furthermore, a thrust force of the intermediate shaft in the back end direction is received by the front bracket alleviating the shock by interposing the buffer, thereby preventing wear of the spacer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Example 1

Figure 1:
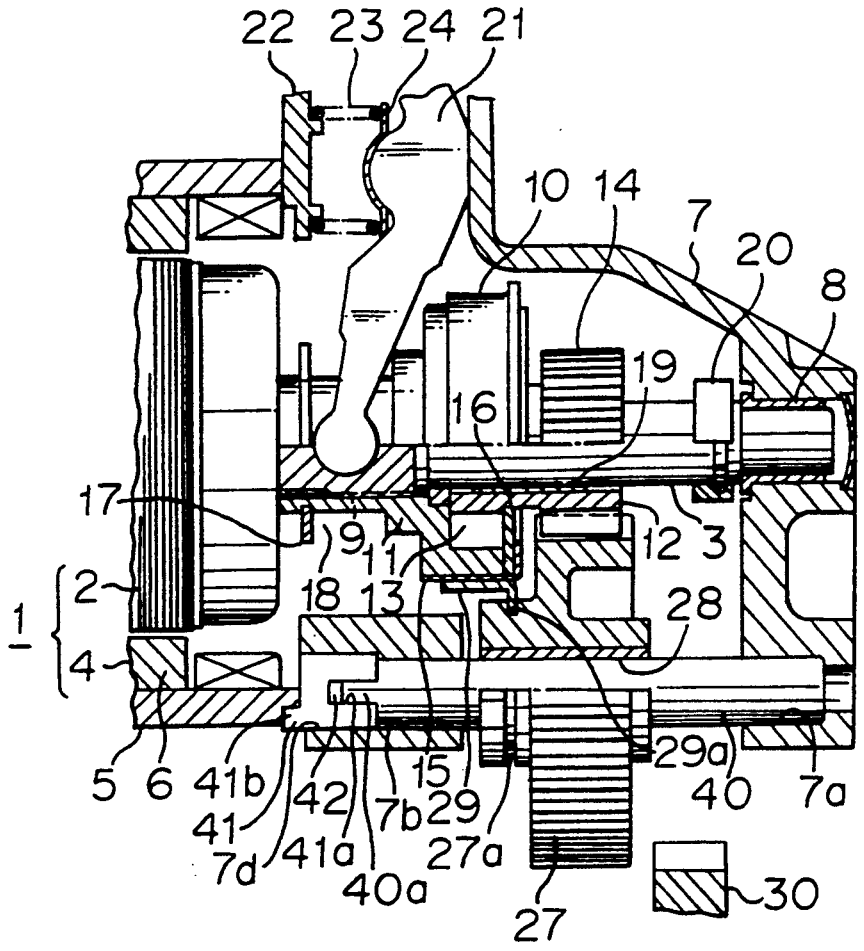
FIG. 1 is a longitudinal sectional diagram showing an important part of an embodiment of a starting motor with an intermediate gear.
Figure 4:
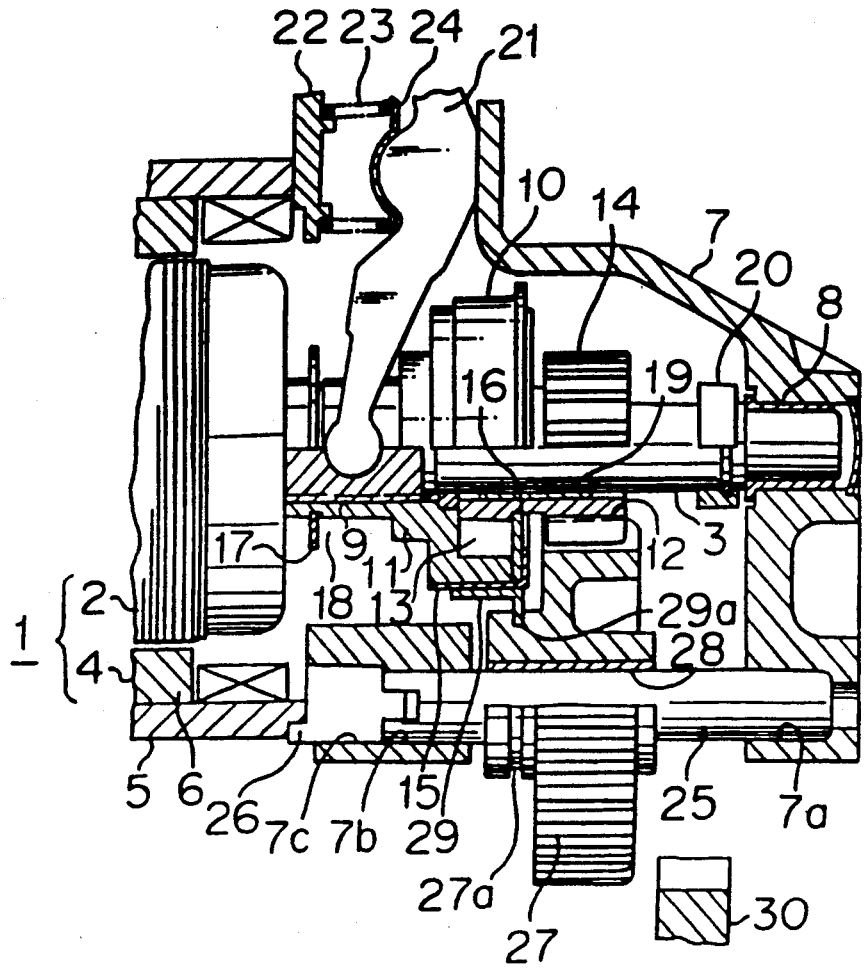
FIGURE 4 PRIOR ART
FIG. 4 is a longitudinal sectional diagram showing an important part of a conventional starting motor with an intermediate gear.
Figure 5:
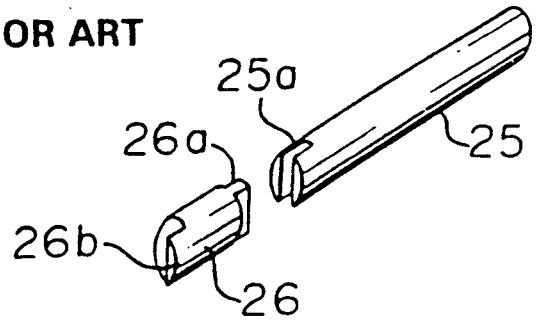
FIGURE 5 PRIOR ART
FIG. 5 is an exploded perspective diagram showing the intermediate shaft and the grommet of FIG. 4.

FIG. 1 is a longitudinal sectional diagram showing an important part of a starting motor with an intermediate gear according to the present invention, wherein notations 1 to 24, 27, 28 to 30, 27*a* and 29*a* are the same with those in FIG. 4. The intermediate gear is supported by an intermediate shaft 40 rotatably and slidably in the axial direction, through the bearing 28, the both ends of which are inserted into the insertion holes 7*a* and 7*b* of the lower front end portion and the lower back end portion of the front bracket 7. At the back end portion of the front bracket 7, a polygonal hole (square hole in the Figure) 7*d* is provided which communicates to an insertion hole 7*b*. A numeral 41 designates a spacer composed of a metallic material or a synthetic resin material, the section of which is a polygon (square in the Figure), which is inserted into a polygonal hole 7*d* with rotation-blocking fixation. The back end of the spacer 41 is received by the front end of the yoke 5 contacting the yoke with respect to the radial and axial directions, the front end of which engages with the back end of the intermediate shaft 40 performing the rotation-blocking, and the spacer 41 receives the thrust force in the backward direction while alleviating it through a buffer 42 made of a gummy material.

Figure 2:
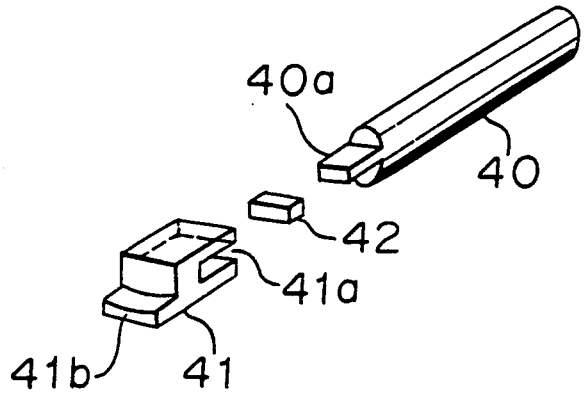
FIG. 2 is an exploded perspective diagram of an intermediate shaft and a spacer.

FIG. 2 is an exploded diagram of the intermediate shaft 40, the spacer 41 and the buffer 42. The spacer 41 is inserted into the polygonal hole 7*d* of the front bracket 7 with the rotation-blocking. An engaging protrusion 40*a* is provided at the back end of the intermediate shaft 40. The spacer 41 is provided with an engaging groove 41*a* at its front end, into which the engaging protrusion 40*a* of the intermediate shaft 40 is inserted thereby performing the rotation-blocking. Furthermore, at the back end of the spacer 41 an engaging protrusion 41*b* is provided which contacts a stepped portion of the front end of the yoke 5 with respect to the radial and axial directions, thereby performing the rotation-blocking and receiving the thrust force. The buffer 42 contacts the innermost face of the engaging groove 41*a* of the spacer 41, engages with a back end face of the engaging protrusion 40*a* of the intermediate shaft 40 and receives the thrust force of the intermediate shaft 40 in the backward direction while alleviating it.

Example 2

Figure 3:
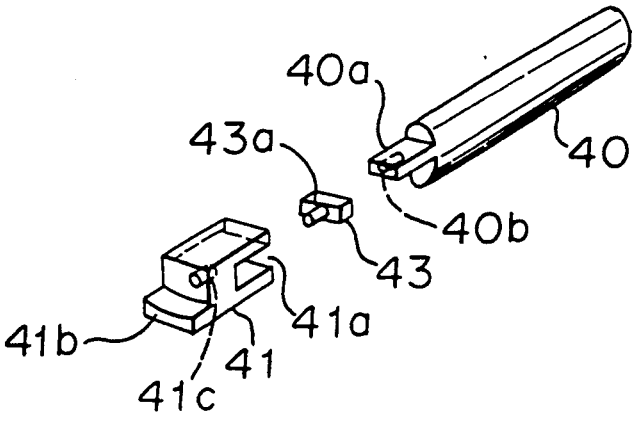
FIG. 3 is an exploded perspective diagram showing an intermediate shaft and a spacer of embodiment 2 according to the present invention.

FIG. 3 is an exploded diagram of an intermediate shaft, a spacer and a buffer of embodiment 2. A buffer 43 made of a gummy material is provided with a retaining protrusion 43*a* at its end face. At the innermost face of an engaging groove 41*a* of the spacer 41, an insertion hole 41*c* for the retaining protrusion 43*a* is provided. By inserting the buffer 43 into the insertion hole 41*c* of the engaging groove 41*a* in use of the retaining protrusion 43*a* in the assembly operation, the dropping-off of the buffer in the operation is prevented. Furthermore, an insertion hole 40*b* shown by the chain line may be provided at the back end of the intermediate shaft 40 and the protrusion 43*a* of the buffer 43 may be inserted thereto. The dropping-off in the assembly operation may be prevented by pressing the buffer 42 into the innermost portion of the engaging groove 41*a* of the spacer 41, or by bonding it thereto by a bonding agent.

Example 3

In the above Examples, the rotation of the rotating shaft 3 of the DC motor 1 is transmitted directly to the overrunning clutch 10. However, this invention is applicable to a case wherein the rotating shaft 3 is shortened and the rotation is reduced by a planetary gear speed reducing device and transmitted to the overrunning clutch.

As stated above, according to the present invention, the spacer made of a metallic material or a synthetic resin material having a polygonal section, is inserted into the polygonal hole provided at the back end of the front bracket communicating to the insertion hole for the intermediate shaft, which is retained at the front end of the yoke by contacting it with respect to the radial and the axial directions, and the back end of the intermediate shaft is connected to the front end of the spacer by the rotation-blocking engaging means. Accordingly, the intermediate shaft is rotation-blocked by the spacer with certainty. Furthermore, the buffer is interposed between the back end of the intermediate shaft and the face of the spacer axially opposing thereto. Therefore, the thrust force of the intermediate shaft in the backward direction is received by the front bracket while alleviating it, the play of the intermediate shaft is prevented and the wear of the spacer is avoided.

Obviously, numerous modifications and variations of the present invention are possible in light of the above teachings. It is therefore to be understood that within the scope of the appended claims, the invention may be practiced otherwise than as specifically described herein.

What is claimed is:

1. A starting motor with an intermediate gear wherein rotation of a rotating shaft of a DC motor is transmitted to a pinion in a one-way rotational direction by an overrunning clutch, and an intermediate gear supported rotatably and forward-and-backward slidably by an intermediate shaft retained by insertion holes in a front end portion and a first back end portion of a front bracket and in mesh with the pinion, meshes with a ring-gear of an internal combustion engine by a forward movement thereof thereby starting the internal combustion engine, wherein;

a polygonal hole is provided at a second back end portion of the front bracket communicating to the insertion hole in the first back end portion thereof;

a spacer composed of a metallic material or a synthetic resin material, a section of which is a polygon, is inserted into the polygonal hole and fixed thereto blocking rotation thereof;

a back end of the spacer is received by a front end of a yoke of the starting motor contacting the front end of the yoke with respect to the radial and axial directions thereof;

a front end of the spacer connects to a back end of the intermediate shaft by a rotation-blocking means; and a buffer is interposed between the front end of the spacer and the back end of the intermediate shaft opposing thereto.

* * * * *